US009125262B2

(12) United States Patent
Osterried

(10) Patent No.: US 9,125,262 B2
(45) Date of Patent: Sep. 1, 2015

(54) CIRCUIT CONFIGURATION FOR OPERATING LEDS FOR A MICROMIRROR ARRANGEMENT

(75) Inventor: Josef Osterried, Ottobrunn (DE)

(73) Assignee: OSRAM GmbH, Munich (DE)

( * ) Notice: Subject to any disclaimer, the term of this patent is extended or adjusted under 35 U.S.C. 154(b) by 782 days.

(21) Appl. No.: 13/390,486

(22) PCT Filed: Jul. 23, 2010

(86) PCT No.: PCT/EP2010/060738
§ 371 (c)(1),
(2), (4) Date: Feb. 14, 2012

(87) PCT Pub. No.: WO2011/018325
PCT Pub. Date: Feb. 17, 2011

(65) Prior Publication Data

US 2012/0146528 A1 Jun. 14, 2012

(30) Foreign Application Priority Data

Aug. 14, 2009 (DE) ..... 10 2009 037 576

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
CPC ..... G02B 26/0833; G02B 26/105
USPC ..... 315/210, 211, 217, 312–325; 348/656, 348/742, 743; 345/46, 31, 99, 48, 55, 82, 345/84, 85; 359/223.1, 224.2, 225.1, 226.1, 359/226.2, 196.1, 197.1, 198.1, 199.4, 359/200.8, 201.1, 201.2, 204.1, 204.2
See application file for complete search history.

(56) References Cited

U.S. PATENT DOCUMENTS 5,706,061 A * 1/1998 Marshall et al. ..... 348/743
6,972,736 B1 * 12/2005 Wada et al. ..... 345/32

(Continued)

FOREIGN PATENT DOCUMENTS

CN 1822084 8/2006
CN 1825401 8/2006

(Continued)

*Primary Examiner* — Lincoln Donovan
*Assistant Examiner* — Thomas Skibinski
(74) *Attorney, Agent, or Firm* — Cozen O'Connor

(57) ABSTRACT

A circuit configuration for operating at least one LED, comprising: an input with a first input terminal (E1) and a second input terminal (E2) for coupling to a DC voltage supply ($U_G$); an output having a first output terminal (A1) and a second output terminal (A2) for providing an output current (IA) to the at least one LED; a micromirror arrangement (12) comprising a plurality of micromirrors; a first control device (16) configured for providing, at the output thereof, a first control signal ($S_a$) for the micromirror arrangement (12), the first control signal ($S_a$) being synchronized to a first clock frequency ($fc_{11}$); a switching regulator (10), the input thereof being coupled to the first input terminal (E1) and the second input terminal (E2), and the output thereof being coupled to the first output terminal (A1) and the second output terminal (A2), the switching regulator (10) comprising a switch (S1); and a second control device (18) configured for providing, at the output thereof, a second control signal (Sb) for the switch (S1) of the switching regulator (10); wherein the second control signal ($S_b$) is synchronized to a second clock frequency ($f_{c12}$), wherein the equation $f_{c12}=n*f_{c11}$ applies, where $n \in \mathbb{I}$.

8 Claims, 3 Drawing Sheets

(56) References Cited

U.S. PATENT DOCUMENTS

| | | | | |
|---|---|---|---|---|
| 7,300,159 | B2 * | 11/2007 | Vanlier | 353/84 |
| 2006/0158566 | A1 | 7/2006 | Sugiyama | |
| 2006/0192728 | A1 | 8/2006 | Kim | |
| 2007/0120786 | A1 * | 5/2007 | Bellls et al. | 345/84 |
| 2007/0176183 | A1 | 8/2007 | Morejon | |
| 2008/0012502 | A1 * | 1/2008 | Lys | 315/247 |
| 2008/0012507 | A1 | 1/2008 | Nalbant | |
| 2008/0158654 | A1 | 7/2008 | Garcia | |
| 2009/0115343 | A1 | 5/2009 | King | |

FOREIGN PATENT DOCUMENTS

| | | |
|---|---|---|
| CN | 101188894 | 5/2008 |
| DE | 202005006910 | 12/2005 |
| DE | 102007038892 | 4/2009 |
| EP | 1691583 | 8/2006 |
| JP | 2003-264091 | 9/2003 |
| JP | 2005-309134 | 11/2005 |
| JP | 2006-229209 | 8/2006 |
| JP | 2007-171364 | 7/2007 |
| JP | 2008-130907 | 6/2008 |

* cited by examiner

CIRCUIT CONFIGURATION FOR OPERATING LEDS FOR A MICROMIRROR ARRANGEMENT

RELATED APPLICATIONS

This is a U.S. national stage of application No. PCT/EP2010/060738, filed on Jul. 23, 2010.

This application claims the priority of German application no. 10 2009 037 576.7 filed Aug. 14, 2009, the entire content of which is hereby incorporated by reference.

FIELD OF THE INVENTION

The present invention relates to a circuit arrangement for operating at least one LED.

In particular, the circuit arrangement can comprise an input with a first input terminal and a second input terminal for coupling to a DC voltage supply, also comprising an output having a first output terminal and a second output terminal for providing an output current to the at least one LED, a micromirror arrangement comprising a plurality of micromirrors, further comprising a first control device configured for providing, at the output thereof, a first control signal for the micromirror arrangement, the first control signal being synchronized to a first clock frequency, also comprising a switching regulator, the input thereof being coupled to the first input terminal and the second input terminal, and the output thereof being coupled to the first output terminal and the second output terminal, the switching regulator comprising a switch, also comprising a second control device configured for providing, at the output thereof, a second control signal for the switch of the switching regulator. The invention also relates to a corresponding method for operating at least one LED.

BACKGROUND OF THE INVENTION

The present invention is concerned, in particular, with a problem that arises in video projectors which use LEDs as the light source and a micromirror actuator as the imaging element. A micromirror actuator is a micromechanical component which, with the aid of individual movable mirrors can be used for controlled light deflection. Using a matrix-shaped arrangement, micromirror actuators can deflect the light of a strong light source, in this case LEDs, such that an image is projected. Designations under which this technology is to be found are Digital Micromirror Device (DMD) and Digital Light Processing (DLP).

The micromirror actuators usually comprise matrix-shaped arrangements of individual elements, the individual micromirrors comprising a tiltable reflective surface with an edge length of a few micrometers. The micromirrors on a DMD chip have, for example, an edge length of approximately 16 μm and are therefore smaller than a fifth of the width of a human hair. The movement is evoked by the force effect of electrostatic fields. Each micromirror can be adjusted individually with respect to the angle thereof and typically has two stable end states, between which said mirror can change up to 5000 times in a second.

DMD chips with an XGA image resolution of 1024×768 pixels contain an array of 786,432 minute mirrors. DMD chips with resolutions of up to 2048×1080 pixels are also now available.

Different brightness levels of the individual image points are generated with binary pulse-width modulated actuation. In order to represent, for example, 32 ($=2^5$) brightness levels, five states are required. Said states differ in how long the DMD is switched, i.e. on. In the first state (bit 0), the mirror is on or off (1 or 0) for the shortest possible time. In the next state (bit 1), the time is doubled, and so on. The total time for a cycle with 5 bits is therefore 496 μs.

In order to generate colored image points, in video projectors which function with LEDs as the light source, three LEDs are normally used, specifically one LED which emits red light, one LED which emits green light and one LED which emits blue light.

In a primitive solution, the image repetition frequency (frame rate) is 60 Hz and thus the frequency at which the three LEDs are operated is 3×60 Hz, which is 180 Hz. In order to avoid the rainbow effect, each image is repeated a plurality of times. Currently 16, 18 or 20 partial images per frame are usual. This results in an on-off frequency of the LEDs of 960, 1080 or 1200 Hz. Given a ⅓ on-time, the pulse lengths, i.e. the switch-on times per LED are therefore approximately 277 μs to 347 μs. Since the image processing algorithm involved is based on the assumption that a constant light amplitude prevails during the whole of each pulse length, then even transient phenomena of approximately 10 μs have a negative effect.

Whereas, when a lamp is used as a light source, few current variations occur because the lamp integrates the current with a time constant of approximately 100 μs, the problem arises, when using an LED as the light source, that the light emitted by the LED follows the driving current practically without delay. If the driving current contains AC components, that is, "ripple currents", the consequence thereof is that image points which should, in principle, be equally bright, are actually displayed at different brightness levels. The alternating current component of the LED current which overlays the DC component of the LED current is designated the ripple current. Whereas at points with a high brightness level, the integrating capability of the human eye integrates mean value variations in the LED current and said variations are therefore rendered insignificant, the lower the brightness level of the image point to be displayed, the more critical said problem becomes. Since the image point is only briefly switched on, the integration capability of the human eye is of no use in this case. The eye now perceives brightness variations.

The relevant LED is therefore not always on, but only when the relevant color is needed to display the respective image point. As previously mentioned, the transient behavior of the respective color is therefore of particular significance. Short time periods are therefore desirable for the transition from a first level to a second level and, because of the aforementioned problem, the AC components of the current should be as small as possible within these time periods, i.e. the target value must be reached as fast as possible and without significant overshoot.

The use of linear controllers or unsynchronized switching regulators as drivers for the LEDs of a video projector, with DMDs as the imaging elements, is known. Linear controllers have the advantage of short rise times and a negligible ripple current or AC component. However, if the output voltage of a driver of this type is approximately 7 V, whilst LEDs usually have a forward voltage in the range of 3 V to 5 V, given a typical LED current of approximately 30 mA, a significant power loss is caused in the switch of the linear controller. This makes complex cooling measures necessary whilst also resulting in poorer efficiency.

Unsynchronized switching regulators, the current waveform from which is essentially triangular, have the advantage of high efficiency since the switch of the switching regulator is either on or off and therefore does not enter a semiconducting state as in the case of a linear controller. However, a compromise is always required between the rise time and the ripple current (the AC component). A short rise time implies a relatively large ripple current, whilst a small ripple current implies a long rise time. The disadvantages associated with a large ripple current have already been set out in detail above. In summary, the use of a linear controller and of an unsynchronized switching regulator therefore both leave problems unsolved.

SUMMARY OF THE INVENTION

It is therefore an object of the present invention to develop a circuit configuration and a method of this type such that the operation of the at least one LED at high efficiency levels and with the smallest possible brightness variations between points that are actually to be displayed equally bright, as well as the shortest possible rise times, is enabled.

This aim is achieved according to an embodiment of the invention in that the second control signal is synchronized to a second clock frequency $f_{c12}$, wherein the following applies:

$$f_{c12}=n*f_{c11}, \text{ where } n\in \mathbb{I} \text{ (integer)},$$

and where $f_{c11}$ represents the first clock frequency.

Since the switching regulator functions at the same frequency as the micromirror arrangement or at a multiple thereof, the ripple current component in the LED current no longer plays any part. The mean value of the LED current is found within a cycle of the micromirror arrangement, independently of the ripple current, since the ripple current averages out under all conditions.

Through this synchronization, firstly, the advantages known from the unsynchronized switching regulator are maintained and, secondly, the switching regulator provides a constant brightness, even for dark image points, and optimization of the rise time is possible.

With a particularly low-complexity realization, the second clock frequency $f_{c12}$ is selected to be equal to the first clock frequency $f_{c11}$.

A realization in which the second clock frequency is n times the first clock frequency ($f_{c12}=n*f_{c11}$), where $n\in \mathbb{I}$ and $n\geq 2$, brings the advantage that the inductances and capacitances of the circuit configuration can be made smaller. It is recommended that the second clock frequency should not be chosen too high, since then the switching losses would outweigh the advantages of the small inductances and capacitances.

In a preferred embodiment, the first clock frequency $f_{c11}$ is in the range of 50 kHz to 200 kHz.

If the output current includes a nominal current which is overlaid by a ripple current, in a preferred exemplary embodiment of an inventive circuit configuration, the switching regulator is configured such that the ripple current amounts to at least 30% of the nominal current, preferably at least 40% of the nominal current, and more preferably at least 50% of the nominal current. This results in very short rise times and thus to a particularly high image quality.

If the switching regulator comprises an inductance, the inductance and the second clock frequency are preferably selected such that a rise in the output current following a switching off procedure has a time constant that is less than 10 μs. Such dimensioning was not possible with the unsynchronized switching regulators known from the prior art without having to accept severe losses in image quality.

Further advantageous embodiments are disclosed in the subclaims.

The preferred embodiments described in relation to the inventive circuit configuration and the advantages thereof apply accordingly, where applicable, to the inventive method.

BRIEF DESCRIPTION OF THE DRAWINGS

An exemplary embodiment of an inventive circuit configuration will now be described making reference to the drawings, in which.

DETAILED DESCRIPTION OF THE DRAWINGS

Figure 1:
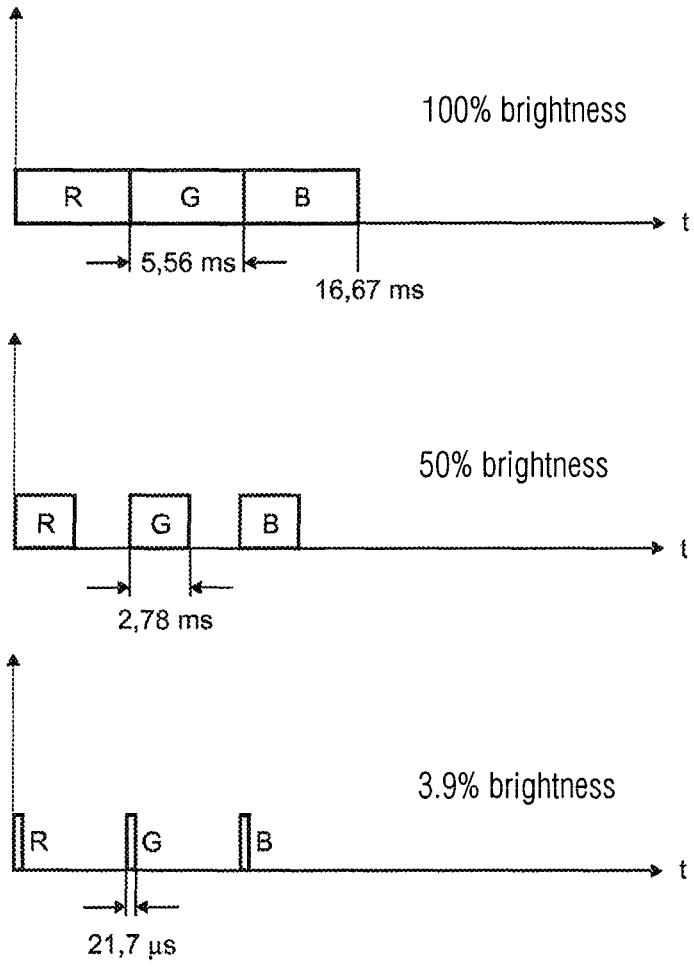
FIG. 1 is a schematic representation of the actuation of a micromirror for realizing three different brightness levels.

FIG. 1 shows a schematic representation of the progress, over time, of the actuation of a micromirror for generating an image point with different brightness levels in a 1-chip arrangement. In the top diagram of FIG. 1, in order to generate an image point at 100% brightness of the micromirror during the red phase, during the green phase and during the blue phase, respectively over the whole interval. Given an image repetition rate of 60 Hz, the interval for each of the three colors is 5.56 ms. Thus, in order to generate an image point at 50% brightness (see the central diagram of FIG. 1), the micromirror is actuated in each color phase for only half the duration, in this case, therefore, for 2.78 ms. The darkest brightness step, which in an 8-bit system is 3.9%, is generated, according to the bottom diagram of FIG. 1, in that, in each color phase, the micromirror is switched on for the duration of only 21.7 μs. If the amplitude of the LED current, integrated over a DMD clock cycle during the actuation of different image points at the same low brightness level varies, the corresponding image points are indeed displayed with different brightness levels and not, as desired, with the same brightness.

Figure 2:
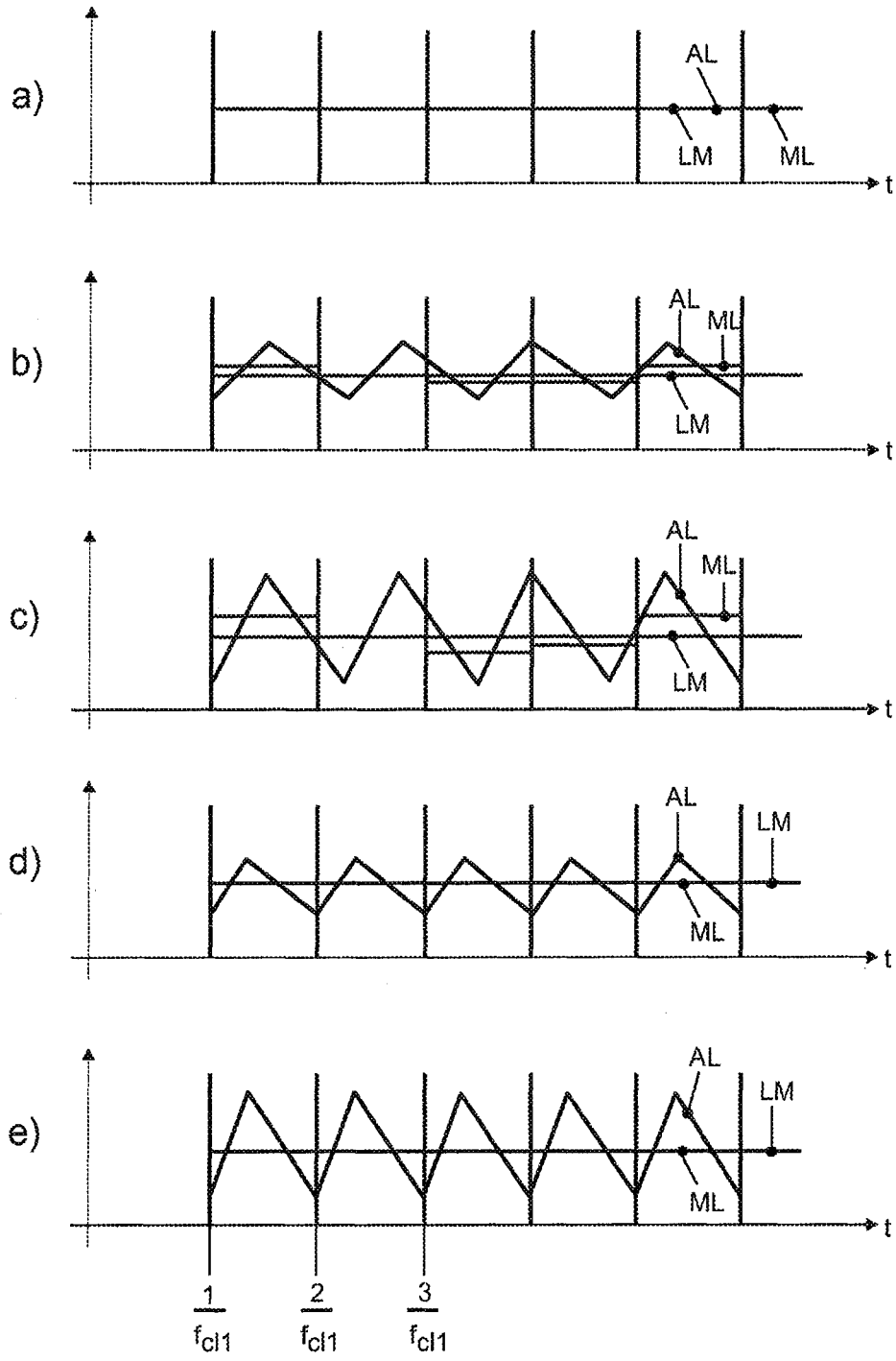
FIG. 2 is the pattern of change, over time, of the light current in relation to a DMD clock signal ($1/f_{c11}$) for a linear controller (a), an unsynchronized switching regulator with heavy smoothing (b), an unsynchronized switching regulator with light smoothing (c), a synchronized switching regulator with heavy smoothing (d) and a synchronized switching regulator with light smoothing (e)

FIG. 2 shows the resultant light current for five different components used within the circuit configuration as drivers for the at least one LED. According to FIG. 2*a*, a linear controller is used, with which an ideal light current is produced. The mean light current ML within a time window (DMD clock cycle) is the same as the longer-term mean value LM. FIG. 2*b* shows the pattern over time using an unsynchronized switching regulator with heavy smoothing. The triangular-shape of the actual light current AL is clearly evident. The mean light current ML within a time window is not equal to the longer-term mean value LM. For the diagram in FIG. 2*c*, an unsynchronized switching regulator with light smoothing was used. Here, the average light current ML within a time window is not equal to the longer-term mean value LM, and the deviations are greater than in the case of the unsynchronized circuit with heavy smoothing as per FIG. 2*b*. FIGS. 2*b* and 2*c* show that, with unsynchronized switching regulators, the mean light current ML within a time window varies. The deviation from the ideal value is dependent on the smoothing of the output current.

For the diagrams in FIGS. 2*d* and 2*e*, an inventive switching regulator was used, that is, a switching regulator in which the clock frequency of the switching regulator is synchronized to the clock frequency of the DMD clock signal. FIG. 2*d* shows the pattern, over time, with heavy smoothing, whilst in FIG. 2*e*, lighter smoothing is applied. It is apparent that, regardless of the degree of smoothing, the mean light current ML within a time window is the same as for the long-term mean value LM.

Figure 3:
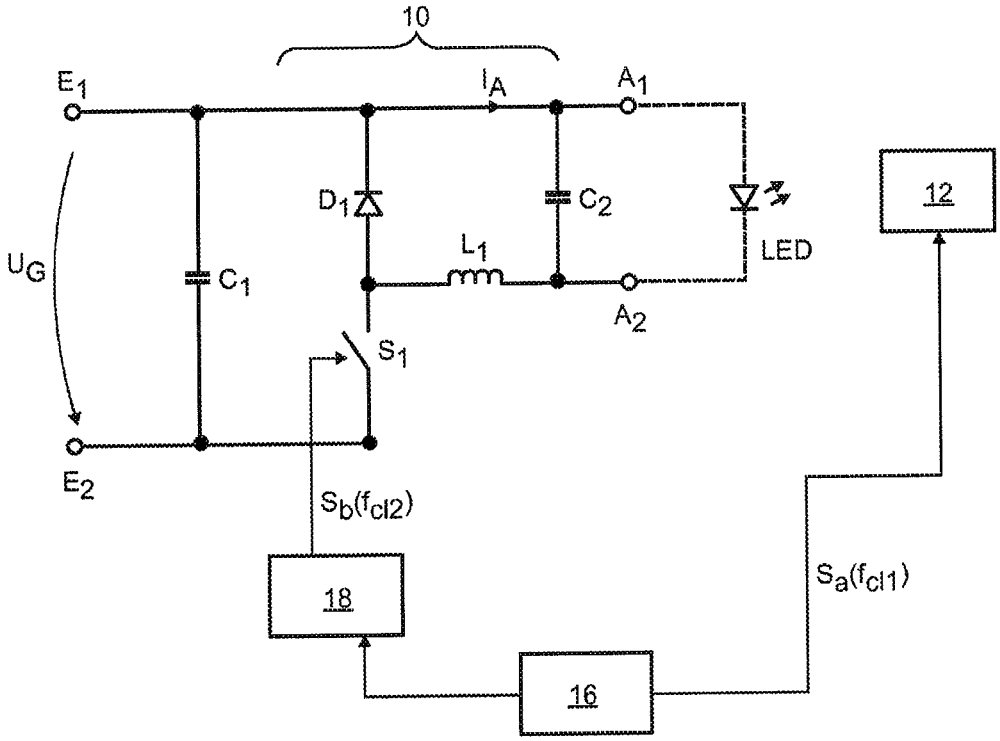
FIG. 3 is a schematic representation of an exemplary embodiment of an inventive circuit configuration.

FIG. 3 shows, in a schematic representation, an exemplary embodiment of an inventive circuit configuration. Said configuration is supplied on the input side with a DC voltage $U_G$, which is applied between a first input terminal E1 and a second input terminal E2. A capacitor C1 is provided to stabilize said voltage. Connected thereto is a switching regulator identified as 10, which here comprises a switch S1, preferably configured as MOSFET, a diode D1 and a coil L1 and, optionally, a capacitor C2. The circuit configuration has an output with a first output terminal A1 and a second output terminal A2, at which an output current $I_A$ is provided for at least one LED connected between the output terminals. The output current $I_A$ comprises a nominal current $I_N$, which is overlaid by a ripple current $I_R$. The circuit configuration also comprises a micromirror arrangement 12. A control device 16 provides, at the output thereof, a control signal $S_a$ for the micromirror arrangement 12, wherein the control signal $S_a$ is synchronized to a first clock frequency $f_{c11}$. The control device 16 is also coupled to a control device 18, which provides, at the output thereof, a control signal $S_b$ for the switch S1 of the switching regulator 10. According to the invention, the control signal $S_b$ is synchronized to a clock frequency $f_{c12}$, wherein the equation $$f_{c12}=n*f_{c11}$$

applies, where n∈ℤ (integer).

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A circuit configuration for operating at least one LED, comprising:

an input with a first input terminal and a second input terminal for coupling to a DC voltage supply;

an output having a first output terminal and a second output terminal for providing an output current to the at least one LED;

a micromirror arrangement comprising a plurality of micromirrors;

a first control device configured for providing, at an output thereof, a first control signal for the micromirror arrangement, the first control signal being synchronized to a first clock frequency ($fc_{11}$);

a switching regulator, an input thereof being coupled to the first input terminal and the second input terminal, and an output thereof being coupled to the first output terminal and the second output terminal, the switching regulator comprising a switch; and a second control device configured for providing, at an output thereof, a second control signal for the switch of the switching regulator;

wherein the second control signal is synchronized to a second clock frequency ($fc_{12}$), wherein the equation $$f_{c12}=n*f_{c11}$$

applies, where n∈.

2. The circuit configuration as claimed in claim 1, wherein $$f_{c12}=f_{c11}.$$

3. The circuit configuration as claimed in claim 1, wherein the equation $$f_{c12}=n*f_{c11} \text{ applies, where } n\in \text{ and } n\geq 2.$$

4. The circuit configuration as claimed in claim 1, wherein the first clock frequency ($f_{c11}$) is in the range of 50 kHz to 200 kHz.

5. The circuit configuration as claimed in claim 1, wherein the output current comprises a nominal current, which is overlaid by a ripple current, the switching regulator being configured such that the ripple current is at least 30% of the nominal current.

6. The circuit configuration as claimed in claim 1, wherein the switching regulator comprises at least one inductance, the inductance and the second clock frequency ($f_{c12}$) being selected such that a rise in the output current following a switching off procedure has a time constant smaller than 10 μs.

7. The circuit configuration as claimed in claim 1, wherein the output current comprises a nominal current, which is overlaid by a ripple current, the switching regulator being configured such that the ripple current is at least 50% of the nominal current.

8. A method for operating at least one LED at a circuit configuration comprising an input with a first input terminal and a second input terminal for coupling to a DC voltage supply, also comprising an output having a first output terminal and a second output terminal for providing an output current to the at least one LED, a micromirror arrangement comprising a plurality of micromirrors, a first control device configured for providing, at an output thereof, a first control signal for the micromirror arrangement, the first control signal being synchronized to a first clock frequency ($f_{c11}$), also comprising a switching regulator, an input thereof being coupled to the first input terminal and the second input terminal and an output thereof being coupled to the first output terminal and the second output terminal, the switching regulator comprising a switch, further comprising a second control device configured for providing, at an output thereof, a second control signal for the switch of the switching regulator wherein the method comprises:

synchronizing the second control signal to a second clock frequency ($f_{c12}$), wherein the equation $$f_{c12}=n*f_{c11}$$

applies, where n∈.

* * * * *